US007132799B2

(12) United States Patent
Yabuki et al.

(10) Patent No.: US 7,132,799 B2
(45) Date of Patent: Nov. 7, 2006

(54) COMPACT SELF-BALLASTED FLUORESCENT LAMP, FLUORESCENT LAMP AND HELICAL GLASS TUBE

(75) Inventors: Tatsuhiro Yabuki, Takatsuki (JP); Noriyuki Uchida, Hirakata (JP); Shiro Iida, Kyoto (JP); Kenji Nakano, Kyoto (JP)

(73) Assignee: Matsushita Electric Industrial Co., Ltd., Osaka (JP)

( * ) Notice: Subject to any disclaimer, the term of this patent is extended or adjusted under 35 U.S.C. 154(b) by 143 days.

(21) Appl. No.: 10/504,722

(22) PCT Filed: Mar. 25, 2003

(86) PCT No.: PCT/JP03/03563

§ 371 (c)(1),
(2), (4) Date: Aug. 16, 2004

(87) PCT Pub. No.: WO03/083896

PCT Pub. Date: Oct. 9, 2003

(65) Prior Publication Data

US 2005/0104522 A1 May 19, 2005

(30) Foreign Application Priority Data

Mar. 28, 2002 (JP) ..... 2002-093018

(51) Int. Cl.

| | |
|---|---|
| ***H01J 17/16*** | (2006.01) |
| ***H01J 61/30*** | (2006.01) |
| ***H01J 9/00*** | (2006.01) |
| ***H01J 9/24*** | (2006.01) |
| ***H01J 9/42*** | (2006.01) |

(52) U.S. Cl. ..... 313/634; 313/573; 313/637; 313/639; 313/493; 445/66; 445/17; 445/22; 445/26

(58) Field of Classification Search ..... 313/634, 313/573

See application file for complete search history.

(56) References Cited

U.S. PATENT DOCUMENTS

| | | | | |
|---|---|---|---|---|
| 5,705,883 | A | 1/1998 | Soules et al. | 313/318.09 |
| 5,731,659 | A | 3/1998 | Soules et al. | 313/487 |
| 5,751,104 | A | 5/1998 | Soules et al. | 313/493 |
| 6,064,155 | A * | 5/2000 | Maya et al. | 315/56 |
| 6,225,742 | B1 | 5/2001 | Iida et al. | 315/56 |

FOREIGN PATENT DOCUMENTS

| | | | |
|---|---|---|---|
| EP | 0 918 352 | A1 | 5/1999 |
| EP | 1 341 208 | A2 | 9/2003 |
| JP | 04138651 | A | 5/1992 |
| JP | 07111146 | A | 4/1995 |
| JP | 07130334 | A | 5/1995 |
| JP | 9-17378 | | 1/1997 |
| JP | 10134614 | A | 5/1998 |
| JP | 2000-200582 | A | 7/2000 |
| JP | 2000-200583 | A | 7/2000 |
| JP | 2001-68060 | A | 3/2001 |

* cited by examiner

*Primary Examiner*—Mariceli Santiago
*Assistant Examiner*—Elizabeth Rielley

(57) ABSTRACT

A diffuser is formed on an inner surface of a globe included in a compact self-ballasted fluorescent lamp, and a diffuse transmittance of the diffuser τ is set at 95%. When designing dimensions of the compact self-ballasted fluorescent lamp, at the same time, a ratio $D_g/P_g$ is set at 0.8 or greater. Here, $P_g$ is a helical pitch of an arc tube having a helical configuration, and $D_g$ is a half of a difference between a helix diameter of the arc tube and a maximum outside diameter of the globe.

22 Claims, 8 Drawing Sheets

FIG.3

| | | |
|---|---|---|
| SPECIFICATIONS OF GLASS TUBE | HELICAL PITCH Pg | 15mm |
| | HELIX DIAMETER Φt | 45mm |
| | TUBE INSIDE DIAMETER $\phi$i | 7.4mm |
| | TUBE OUTSIDE DIAMETER $\phi$o | 9.0mm |
| | INTER-ELECTRODE DISTANCE Le | 400mm |
| | FULL LENGTH Lo | 75mm |
| SPECIFICATIONS OF GLOBE | DIFFUSE TRANSMITTANCE $\tau$ | 95% |
| | MAXIMUM DIAMETER Φo | 55mm |
| POWER INPUT | | 11W |

FIG.4

| | |
|---|---|
| LUMINOUS FLUX | 795 lm |
| EFFICIENCY | 72.3 lm/W |
| RATED LIFETIME | 6,000 HOURS OR MORE |

FIG.6
(i)
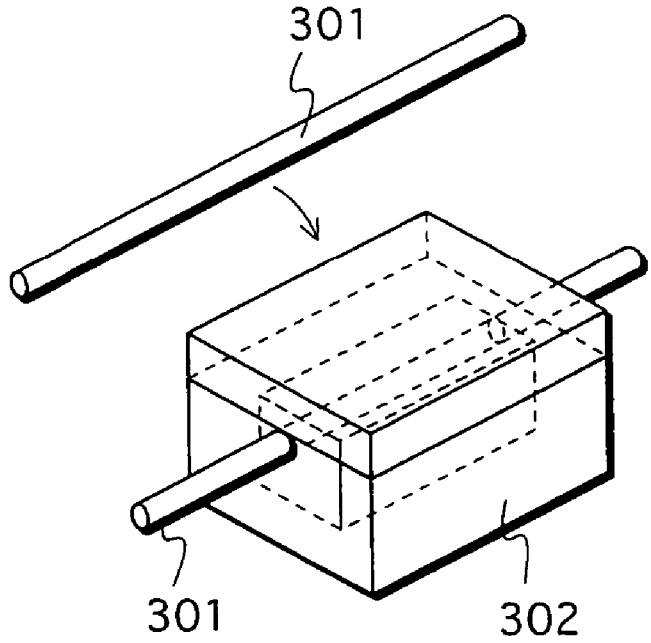
(ii)
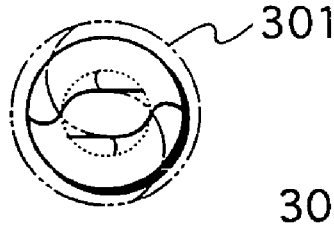
(iii)
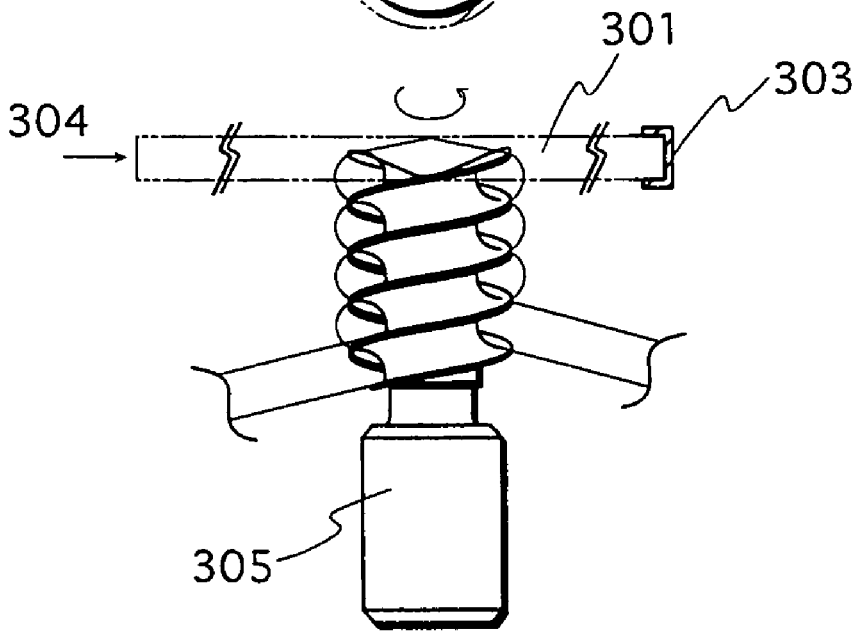

FIG.8

| | | |
|---|---|---|
| SPECIFICATIONS OF GLASS TUBE | HELICAL PITCH Pg | 10mm |
| | HELIX DIAMETER Φt | 36.5mm |
| | TUBE INSIDE DIAMETER $\phi$i | 7.4mm |
| | TUBE OUTSIDE DIAMETER $\phi$o | 9.0mm |
| | INTER-ELECTRODE DISTANCE Le | 400mm |
| | FULL LENGTH Lo | 65mm |
| SPECIFICATIONS OF GLOBE | DIFFUSE TRANSMITTANCE $\tau$ | 99% |
| | MAXIMUM DIAMETER Φo | 55mm |
| FULL LENGTH OF LAMP Lo | | 110mm |
| MAXIMUM GAP Dg | | 9.3mm |
| VALUE OF Dg/Pg | | 0.93 |
| RATIO Φt/$\phi$o (3.5 ~ 4.5) | | 4.06 |
| FORMING PROCESS TEMPERATURE | | 740℃ |

COMPACT SELF-BALLASTED FLUORESCENT LAMP, FLUORESCENT LAMP AND HELICAL GLASS TUBE

TECHNICAL FIELD

The present invention relates to a compact self-ballasted fluorescent lamp, a fluorescent lamp, and a manufacturing method of a helical glass tube, particularly to improvement of unevenness in luminance of a compact self-ballasted fluorescent lamp.

BACKGROUND ART

In the field of lighting equipment, the general trend for energy saving has been promoting widespread use of compact self-ballasted fluorescent lamps as an energy-saving light source alternative to ordinary electric lamps. Such compact self-ballasted fluorescent lamps are grouped into types with and without a globe. The type with a globe has, for instance, a called medium globe, which is similar to that of ordinary electric lamps, and has excellent appearance.

Such a compact self-ballasted fluorescent lamp has one or more glass tubes, and the glass tubes may be helical glass tubes or U-shaped glass tubes. Some compact self-ballasted fluorescent lamps have three or four U-shaped glass tubes. Here, a helical glass tube has been attracting attention, since it secures a larger arc length in a limited space inside a globe and therefore enables a high luminous efficiency to be realized.

As described above, glass tubes of various configurations are used for compact self-ballasted fluorescent lamps. Here, unevenness of luminance is sometimes observed in compact self-ballasted fluorescent lamps. To eliminate unevenness in luminance of a compact self-ballasted fluorescent lamp with a globe, conventionally, the thickness of a diffuser that is formed on the inner surface of the globe to diffuse light emitted from a glass tube is increased.

However, an increase in thickness of a diffuser poses the following problem. The increase inevitably causes the quantity of light emitted by a compact self-ballasted fluorescent lamp to attenuate, which lowers luminous efficiency. Accordingly, even though a helical glass tube is employed to realize high luminous efficiency, an attempt to eliminate unevenness of luminance causes luminous efficiency to be lower than expected.

In the light of the above problem, it is an object of the present invention to provide a compact self-ballasted fluorescent lamp that includes a glass tube that has been bent to form a helical configuration, in which unevenness of luminance is eliminated without causing a drop in high luminous efficiency, and a manufacturing method for the same.

DISCLOSURE OF THE INVENTION

The above objective can be achieved by a compact self-ballasted fluorescent lamp in which a globe mantles an arc tube having a helical configuration. Here, when $P_g$ is a helical pitch of the arc tube and $D_g$ is a half of a difference between a maximum outside diameter of the globe and a helix diameter of the arc tube, a ratio of $D_g/P_g$ is 0.8 or more.

Here, the globe is light diffusive. With this construction, even if a diffuse transmittance of the globe is equal to that of a conventional lamp, unevenness of luminance in the middle part of the globe can be reduced so as to be invisible for human eyes. Accordingly, a compact self-ballasted fluorescent lamp which has excellent appearance and is highly compatible with an ordinary electric lamp is realized as an alternative to ordinary electric lamps.

Here, a diffuse transmittance of the globe is 95% or higher. With this construction, a luminaire efficiency of the compact self-ballasted fluorescent lamp can be equal to that of a conventional lamp.

Here, the ratio of $D_g/P_g$ is 0.9 or more, and the diffuse transmittance of the globe is 98% or higher. This construction enables unevenness of luminance in the middle part of the globe to be eliminated, with it being possible to achieve a higher luminaire efficiency compared with a conventional lamp.

Here, elemental mercury is enclosed into the arc tube, a tube inside diameter of the arc tube is within a range of 5.0 mm to 9.0 mm, and apart of the arc tube is thermally connected to the globe by means of a heat-conductive medium. This construction enables a luminous flux rising characteristic of the compact self-ballasted fluorescent lamp to be approximately equal to that of an ordinary fluorescent lamp.

Here, it is desirable that the part of the arc tube includes a coldest point in the arc tube and the heat-conductive medium is made of silicone.

Here, the maximum outside diameter of the globe is approximately 60 mm or less. With this construction, a compatibility of the compact self-ballasted fluorescent lamp to a lamp holder for an ordinary electric lamp can be raised to as high as around 80%. Therefore, the compact self-ballasted fluorescent lamp is highly compatible with an ordinary electric lamp.

The objective can be also achieved by a fluorescent lamp in which a globe mantles an arc tube having a helical configuration. Here, when $P_g$ is a helical pitch of the arc tube and $D_g$ is a half of a difference between a maximum outside diameter of the globe and a helix diameter of the arc tube, a ratio of $D_g/P_g$ is 0.8 or more.

Here, the globe is light diffusive. This construction enables unevenness of luminance to be reduced, and therefore achieves excellent appearance.

Here, a diffuse transmittance of the globe is 95% or higher. With this construction, a luminaire efficiency of the fluorescent lamp can be equal to that of a conventional lamp.

Here, the ratio of $D_g/P_g$ is 0.9 or more, and the diffuse transmittance of the globe is 98% or higher. This construction enables unevenness of luminance in the middle part of the globe to be eliminated, with achieving a high luminaire efficiency.

Here, elemental mercury is enclosed into the arc tube, a tube inside diameter of the arc tube is within a range of 5.0 mm to 9.0 mm, and a part of the arc tube is thermally connected to the globe by means of a heat-conductive medium. This construction enables a luminous flux rising characteristic of the fluorescent lamp to be approximately equal to that of an ordinary fluorescent lamp.

Here, it is desirable that the part of the arc tube includes a coldest point in the arc tube and the heat-conductive medium is made of silicone.

Here, the maximum outside diameter of the globe is approximately 60 mm or less. With this construction, a compatibility of the fluorescent lamp to a lamp holder for an ordinary electric lamp can be raised to as high as around 80%. Therefore, the fluorescent lamp is highly compatible with an ordinary electric lamp.

The objective can be also achieved by a manufacturing method of a helical glass tube that is formed by a glass tube made of a soft glass material, the helical glass tube having a helical pitch of no more than 12 mm and a $\Phi t/\phi o$ ratio of within a range of 3.5 to 4.5, where Φt is a helix diameter of the helical glass tube and φo is a tube outside diameter of the helical glass tube. The manufacturing method comprises a heating step of heating the glass tube to be softened, and a forming step of, around a forming jig having a helical configuration, winding the glass tube that has been softened in the heating step at a forming temperature which is, by from 50° C. to 150° C., higher than a softening point of the soft glass material.

The objective can be also achieved by a manufacturing method of a helical glass tube that is formed by a glass tube made of a soft glass material, the helical glass tube having a helical pitch of no more than 12 mm and a Φt/φo ratio of within a range of 3.5 to 4.5, where Φt is a helix diameter of the helical glass tube and φo is a tube outside diameter of the helical glass tube. The manufacturing method comprises a heating step of heating the glass tube to be softened, and a forming step of, around a forming jig having a helical configuration, winding the glass tube that has been softened in the heating step at a forming temperature of within a range between 720° C. and 820° C. Thus, the helical glass tube with excellent finished dimension accuracy is obtained.

A glass tube which is to be processed using the above-described manufacturing methods is preferably a linear tube. This is because such a linear tube is easy to be wound around a forming jig after being softened.

A compact self-ballasted fluorescent lamp which is an embodiment of the present invention is characterized by including an arc tube which is formed by a helical glass tube that is manufactured in a manufacturing method of a helical glass tube which is an embodiment of the present invention. With this construction, a helical glass tube with high finished dimension accuracy can be used in a compact self-ballasted fluorescent lamp. This enables unevenness of luminance to be eliminated, and achieves excellent appearance.

BRIEF DESCRIPTION OF THE DRAWINGS

FIG. 3 is a table that states specifications of a compact self-ballasted florescent lamp that is examined in an experiment.

FIG. 4 is a table that states experimentally-proved performance of the compact self-ballasted florescent lamp which has the specifications described in FIG. 3.

FIG. 6 shows, step by step, a manufacturing process of a helical glass tube.

FIG. 8 shows, for example, dimensions of a compact self-ballasted florescent lamp relating to a modification example.

BEST MODE FOR CARRYING OUT THE INVENTION

The following part describes an embodiment of a compact self-ballasted florescent lamp according to the present invention, with reference to the attached figures.

Figure 1:
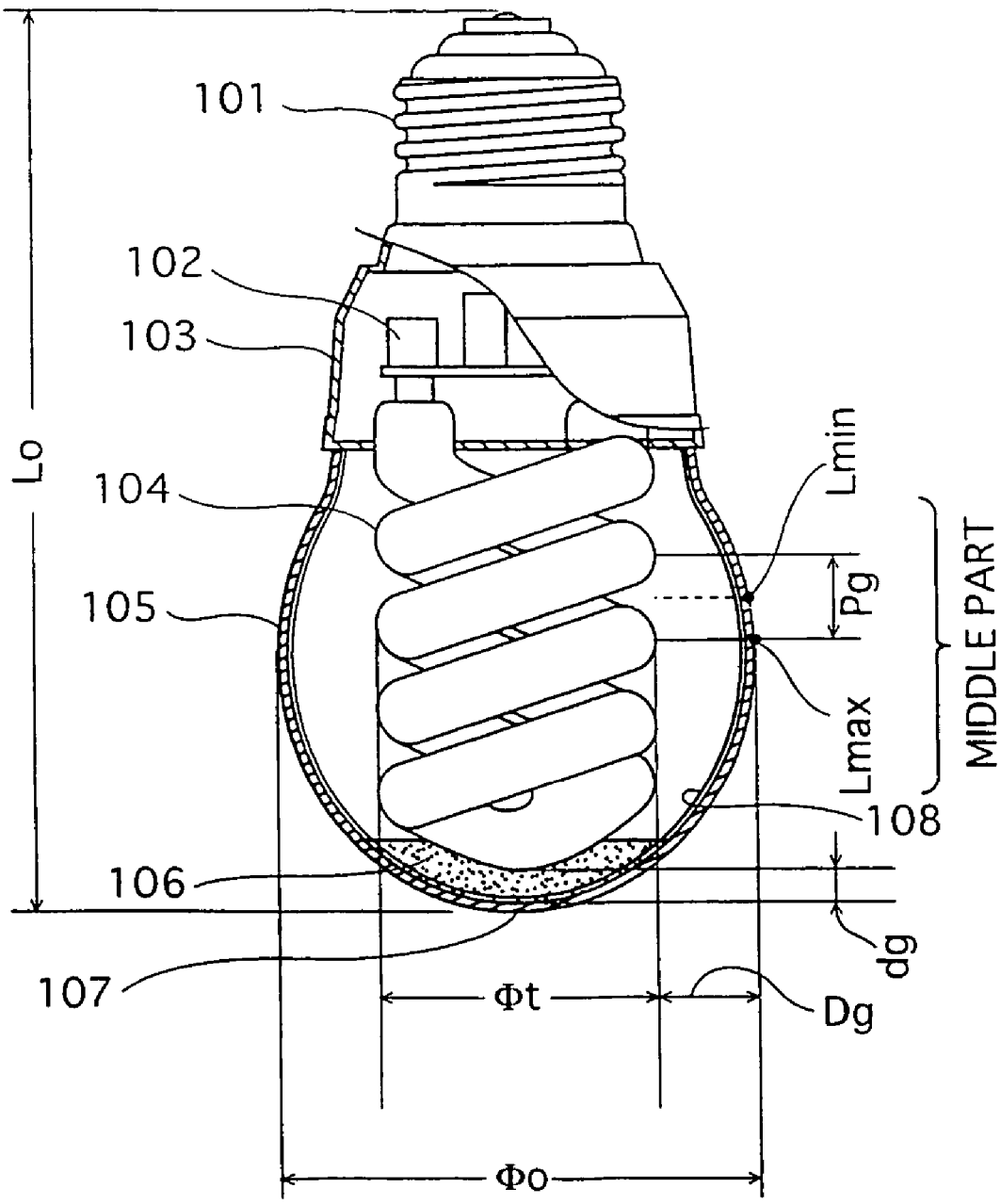
FIG. 1 is a front view showing a construction of the whole of a compact self-ballasted florescent lamp relating to an embodiment of the present invention and an inner structure of the compact self-ballasted florescent lamp by removing part of a globe constituting the compact self-ballasted florescent lamp.

[1] Construction of a Compact Self-ballasted Florescent Lamp Relating to the Embodiment The compact self-ballasted florescent lamp relating to the embodiment is an 11-watt compact self-ballasted florescent lamp, which is designed as an alternative to a 60-watt incandescent lamp. FIG. 1 is a front view showing a construction of the whole of the compact self-ballasted florescent lamp relating to the embodiment, with part of its globe being removed. According to FIG. 1, a compact self-ballasted florescent lamp 1 includes a globe 105, a resin case 103, and an E-shaped base 101, and the lamp length $L_o$ from the tip of the base 101 to a top point 107 in the globe 105 is 75 mm.

The resin case 103 is made of synthetic resin and hollow. The resin case 103 includes therein an electronic circuit 102 such as an electronic ballast that is driven using a series inverter method at a circuit efficiency of 91% and an electronic starter. It should be noted that the wiring and the like of the electronic circuit 102 are not shown in FIG. 1. Here, the electronic circuit 102 is mounted on one of the main surfaces of a flat holding member. The holding member is fixed to the inner surface of the resin case 103 along its peripheries using an adhesive agent, a screw or the like in such a state that the main surface on which the electronic circuit 102 is mounted faces the base 101.

The globe 105 is commonly called medium or an A-shaped globe, and is made of a glass material, like globes of ordinary electric lamps, so as to achieve excellent appearance. A diffuser 108 is made of a powder mainly composed of calcium carbonate, and formed on the inner surface of the globe 105. The diffuse transmittance τ, which indicates a proportion of light that is diffused by the diffuser 108 of light transmitted through the globe 105, is 98%.

The maximum outside diameter of the globe 105 Φo is around 60 mm, and approximately equal to that of an ordinary electric lamp. The maximum outside diameter Φo can be, however, smaller than 60 mm. The globe 105 is fixed to the resin case 103 with an adhesive agent or the like in such a manner that the opening portion of the globe 105 is inserted into the resin case 103 to be sealed together. The globe 105 and the resin case 103 constitute an outer peripheral casing.

Inside the outer peripheral casing, an arc tube 104 that has been processed to form a helical configuration is located. A holder with a receptacle is disposed on one side of the resin case 103 which is opposite to the base 101 side. The arc tube 104 is mounted to the receptacle of the holder. The arc tube 104 receives power supply through the receptacle and mechanically supported by the receptacle. The arc tube 104 is fixed to the receptacle using a power supplying terminal (not illustrated).

Figure 2:
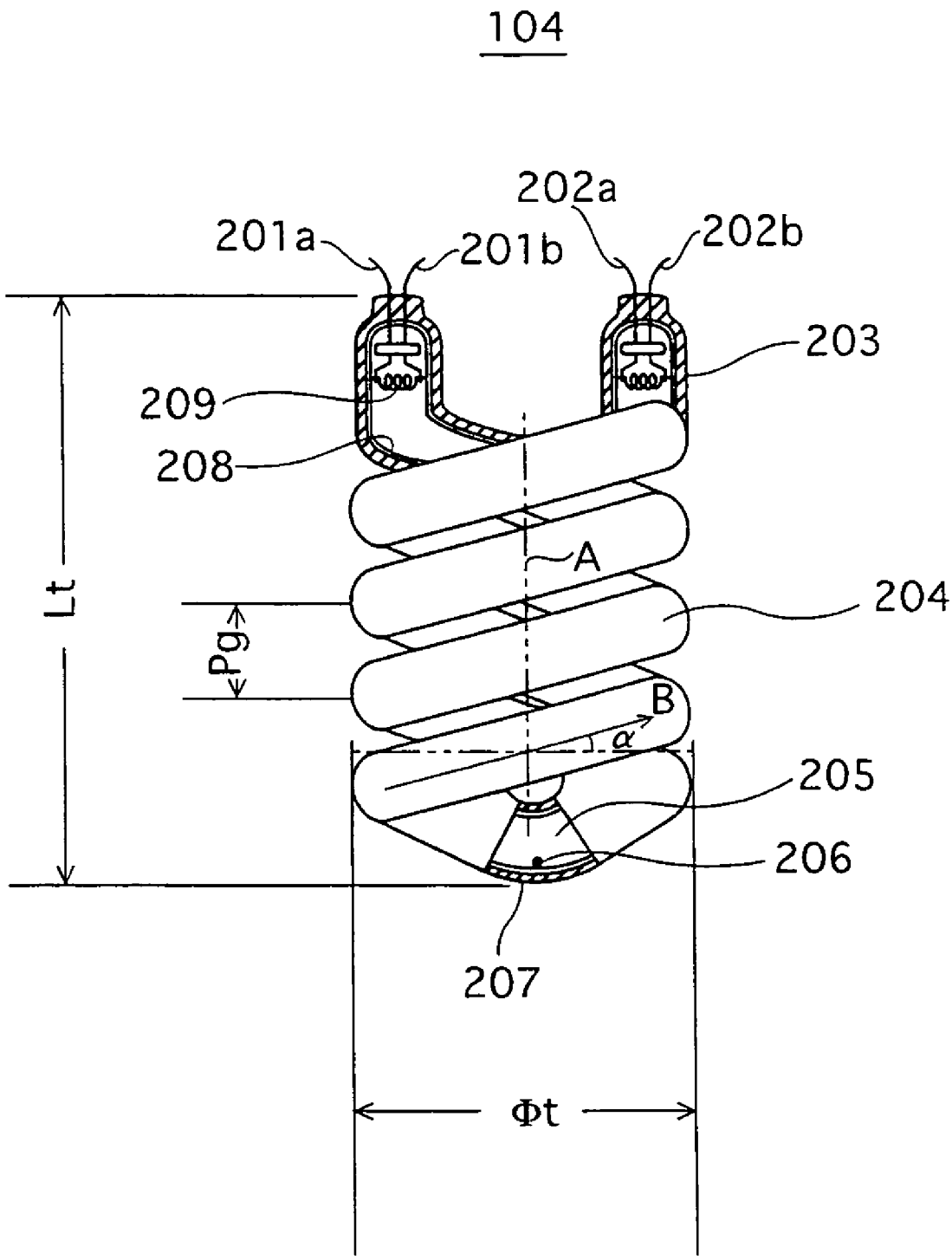
FIG. 2 is a front view showing a construction of the whole of an arc tube 104 (shown in FIG. 1) and an inner structure of the arc tube 104 by removing part of the arc tube 104.

FIG. 2 is a front view showing a construction of the arc tube 104, with part of the arc tube 104 being removed. A glass tube 204 which constitutes the arc tube 104 turns at a turning portion 207 which almost corresponds to the lengthwise middle of the glass tube 204. Then, the glass tube 204 is twisted in such a manner that its each lengthwise half is wound around a pivot A. In this way, the glass tube 204 has a double helical configuration starting from the turning portion 207 to both ends of the glass tube 204.

Here, an angle α between a line running through a cross-sectional center of the glass tube 204 and a horizontal line (perpendicular to the pivot A) (hereinafter referred to as a helix angle α) is largely constant. According to this construction, when compared with a U-shaped arc tube, the path in the arc tube 104 between electrodes can be made longer, which enables the arc tube 104 as a whole to be made smaller.

The glass tube 204 is made of barium strontium silicate glass, which is soft glass without lead and has a softening point of 682° C. The tube inside diameter of a main portion of the arc tube 104 ϕ i falls within a range of 5.0 mm to 9.0 mm. This range is determined in relation to a heat conductive medium 106 (explained later). A phosphor material is applied onto the inner surface of the glass tube 204, to form a fluorescent layer 208.

Coil electrodes 203 and 209 made of tungsten are enclosed in each end portion of the glass tube 204. The coil electrodes 203 and 209 are connected to a pair of lead wires 202*a* and 202*b* and a pair of lead wires 201*a* and 201*b* respectively, which support the coil electrodes 203 and 209. The lead wires 201*a* and 201*b* are provisionally connected to each other with beads glass, and so are the lead wires 202*a* and 202*b*. After this, the pair of the lead wires 201*a* and 201*b* and the pair of the lead wires 202*a* and 202*b* are respectively sealed in such a state that the lead wires 201*a*, 201*b*, 202*a* and 202*b* are inserted into the glass tube 204. This method is called a beads mounting method.

Because of the above-mentioned sealing, the glass tube 204 is hermetically sealed. Here, elemental mercury 206 (around 5 mg) is enclosed in the glass tube 204. In this way, a mercury vapor pressure inside the glass tube 204 when light emission is performed in the arc tube 104 represents the vapor pressure of elemental mercury.

Note that the elemental mercury 206 may be replaced with mercury whose mercury vapor pressure during illumination is in the vicinity of the vapor pressure of elemental mercury. Example alternatives include zinc amalgam and tin amalgam. In addition to the mercury 206, an Ar—Ne gas mixture 205 is enclosed in the glass tube 204 at a pressure of 400 Pa. The Ar—Ne gas mixture 205 functions as buffer gas.

A rare-earth phosphor material is applied to the inner surface of the glass tube 204. The phosphor material is a mixture of europium activated yttrium oxide ($Y_2O_3$:Eu), cerium and terbium activated lanthanum phosphate ($L_aPO_4$: Ce,Tb), and europium and manganese activated barium magnesium aluminate ($BaMg_2Al_{16}O_{27}$:Eu, Mn). When receiving ultraviolet rays emitted by the mercury 206, the europium activated yttrium oxide emits red light, the cerium and terbium activated lanthanum phosphate emits green light, and the europium and manganese activated barium magnesium aluminate emits blue light.

A top point 207 is, in the arc tube 104, most distant from the coil electrodes 203 and 209, and therefore shows the lowest temperature in the arc tube 104 (hereinafter referred to as the coldest point). The top point 207 is connected to the top point 107 in the globe 105 with a heat-conductive medium 106 therebetween as shown in FIG. 1. Here, the heat-conductive medium 106 is made of transparent silicone.

For the purpose of heat conduction, the heat-conductive medium 106 can be made of metal, synthetic resin, rubber or the like, instead of silicone. However, for the original purpose of a luminaire, it is naturally desirable that the heat-conductive medium 106 has a high light transmittance. In addition, as silicone also has excellent heat resistance, transparent silicone resin is suitable for the heat-conductive medium 106.

With the above-described configuration, when the arc tube 104 releases heat as a result of light emission therein, the heat is conducted to the globe 105 through the heat-conductive medium 106, to be dissipated into open air. Accordingly, the rise of the temperature of the arc tube 104, particularly the rise of the temperature of the top point 207 in the arc tube 104 can be suppressed.

The vapor pressure of the mercury 206 enclosed in the arc tube 104 when the arc tube 104 is illuminated is subject to the temperature of the coldest point. In detail, as the temperature of the coldest point (hereinafter referred to as coldest point temperature) becomes lower, the mercury vapor pressure in the arc tube 104 drops. Accordingly, if a heat dissipation path is provided with the top part 207 by disposing the heat-conductive medium 106 as described above, a desirable mercury vapor pressure in the arc tube 104 can be achieved by adjusting the coldest point temperature.

According to the present embodiment, the distance between the top point 207 in the arc tube 104 and the top point 107 of the globe 105 (hereinafter referred to as a bonding gap $d_g$) is 2 mm. The top point 207 is at the depth of 2 mm in the heat-conductive medium 106 (a buried depth $d_s$). With this configuration, if the tube inside diameter of the arc tube 104 ϕi is appropriately set, the coldest point temperature falls within a temperature range (60° C. to 65° C.) which achieves a maximum luminaire efficiency. As a result, an excellent luminous flux rising characteristic and a high luminaire efficiency can be attained.

As described before, the globe 105 is a medium globe, that is to say, swollen in its lengthwise middle part as shown in FIG. 1. The helical pitch $P_g$ in a portion of the glass tube 204 which corresponds to the middle part of the globe 105 is 10 mm. The helix diameter of the glass tube 204 Φt is 36 mm. A maximum gap $D_g$ is a half of the difference between the helix diameter of the glass tube 204 and the maximum outside diameter of the globe 105, and can be calculated from the following formula, based on the maximum outside diameter of the globe 105 Φo and the helix diameter of the glass tube 204 Φt.

$$D_g=(\Phi o-\Phi t)/2$$

The maximum gap $D_g$ is 12 mm in the present embodiment from the above formula.

The helical pitch $P_g$ of the glass tube 204 in this description denotes, in a portion of the glass tube 204 where a center line of the glass tube 204 is a helical curve, a distance between adjacent portions of the center line. Here, such adjacent portions are adjacent to each other in the direction of the helical axis of the glass tube 204.

The helical pitch $P_g$ may be measured in the following manner. As shown in FIG. 2, the helical pitch $P_g$ is approximately equal to a distance between two points on the adjacent portions of the glass tube 204. The two points are each included in a cylindrical surface that includes the helix circumference of the glass tube 204.

Therefore, the helical pitch $P_g$ can be obtained using a scale, by placing the scale almost in parallel to the helical axis along the glass tube 204 and measuring the distance between two points on adjacent portions of the glass tube 204 which are in contact with the scale.

Alternatively, the helical pitch $P_g$ may be obtained by, using a vernier caliper for example, measuring a distance between top or bottom points on adjacent cross-sectional circles of the glass tube 204 in the direction of the helical axis.

Here, if the tube outside diameter of the glass tube 204 is constant, as the helical pitch $P_g$ of the glass tube 204 becomes larger, the distance between adjacent portions of the glass tube 204 becomes larger. This increases unevenness of luminance during light emission, when the arc tube 104 is seen from a direction perpendicular to the pivot A. In addition, when the maximum gap $D_g$ is larger, the light emitted from the arc tube 104 is more mixed before the light reaches the globe 105, which suppresses unevenness of luminance.

Accordingly, it can be said that unevenness in luminance of the compact self-ballasted florescent lamp becomes smaller as the value of $D_g/P_g$ becomes larger. An experiment mentioned later has proved that the value of $D_g/P_g$ is preferably no less than 0.9, when the globe 105 has a diffuse transmittance $\tau$ of 98%. Here, in the compact self-ballasted florescent lamp 1 relating to the present embodiment, the globe 105 has a diffuse transmittance $\tau$ of 98%, and the value of $D_g/P_g$ is no less than 0.9 as follows.

$$\begin{aligned} D_g/P_g &= (\Phi o - \Phi t)/2/P_g \\ &= (60-36)/2/10 \\ &= 1.2 \end{aligned}$$

Therefore, unevenness in luminance of the compact self-ballasted fluorescent lamp 1 is sufficiently suppressed.

[2] Experiments

As explained above, unevenness in luminance of a compact self-ballasted florescent lamp, especially unevenness of luminance in the middle part (shown in FIG. 1), is subject to the value of $D_g/P_g$.

Accordingly, it is thought beneficial to identify a range of the value of $D_g/P_g$ which enables unevenness of luminance to be suppressed so as to realize a desirable compact self-ballasted florescent lamp. Identification of such a range will help designing a configuration of better quality compact self-ballasted florescent lamps.

[2.1] Conventional Compact Self-ballasted Florescent Lamp (1)

An evaluation experiment of a conventional self-ballasted florescent lamp (1) was performed to clarify problems concerning unevenness of luminance. FIG. 3 is a table stating specifications of the evaluated compact self-ballasted florescent lamp (1) FIG. 4 presents the experimentally-proved performance of the compact self-ballasted florescent lamp (1) having the specifications shown in FIG. 3.

It is confirmed that the luminous flux rising characteristic of the compact self-ballasted florescent lamp (1) is similar to that of an ordinary fluorescent lamp.

According to visual observation results, unevenness in luminance of the compact self-ballasted fluorescent lamp (1) is most evident on a portion of the surface of the globe of the lamp (1) which corresponds to its middle part (defined in FIG. 1). The unevenness in luminance is considerably worse than unevenness in luminance of an existing florescent lamp which includes three or four U-shaped glass tubes, and unfavorable in terms of appearance.

In this evaluation experiment, maximum luminance $L_{max}$ and minimum luminance $L_{min}$ of the compact self-ballasted fluorescent lamp (1) were measured to obtain a ratio of the luminance $L_{min}$ to the luminance $L_{max}$ ($L_{min}/L_{max}$). Here, the maximum luminance $L_{max}$ is the highest luminance in the middle part of the globe, and the minimum luminance is the lowest luminance in the middle part of the globe. The luminance ratio $L_{min}/L_{max}$ of the compact self-ballasted fluorescent lamp (1) is 0.7.

Here, ordinary electric lamps other than a fluorescent lamp, for example, an incandescent lamp, achieve even luminance distribution, and therefore exhibit the luminance ratio $L_{min}/L_{max}$ of 1. Taking this into consideration, the above evaluation result is not a very good result.

[2.2] Compact Self-ballasted Fluorescent Lamp (2)

An evaluation experiment of a compact self-ballasted fluorescent lamp having the same specifications as the fluorescent lamp (1) except a different diffuse transmittance $\tau$ of 92% was performed. The diffuse transmittance $\tau$ was varied by adjusting the diffuser applied to the globe. According to the evaluation results, the luminance ratio $L_{min}/L_{max}$ is improved to 0.90.

Nevertheless, the luminaire efficiency of the compact self-ballasted florescent lamp (2) is 70.31 1m/W, which is, by around 3%, lower than that of a florescent lamp which has the diffuse transmittance $\tau$ of 95%. Which is to say, although unevenness of luminance can be reduced, only low luminance is achieved for high power consumption. In conclusion, this evaluation experiment has confirmed that an attempt to suppress unevenness of luminance by lowering a diffuse transmittance $\tau$ does not produce favorable effects.

[2.3] Relation Between Unevenness of Luminance and the Value of $D_g/P_g$

If the tube outside diameter of the glass tube 204 is constant, a larger helical pitch $P_g$ means a larger distance between adjacent portions of the glass tube 204. This increases unevenness of luminance in the middle part (shown in FIG. 1). On the other hand, if the maximum gap $D_g$ is large, emitted light can be well mixed, which reduces unevenness of luminance.

Here, an experiment was performed where several compact self-ballasted fluorescent lamps which are the same in terms of the maximum gap $D_g$ but different from each other in terms of the helical pitch $P_g$ were manufactured. Thus, luminance and the luminance ratio $L_{min}/L_{max}$ were obtained for each of the compact self-ballasted fluorescent lamps.

Figure 5:
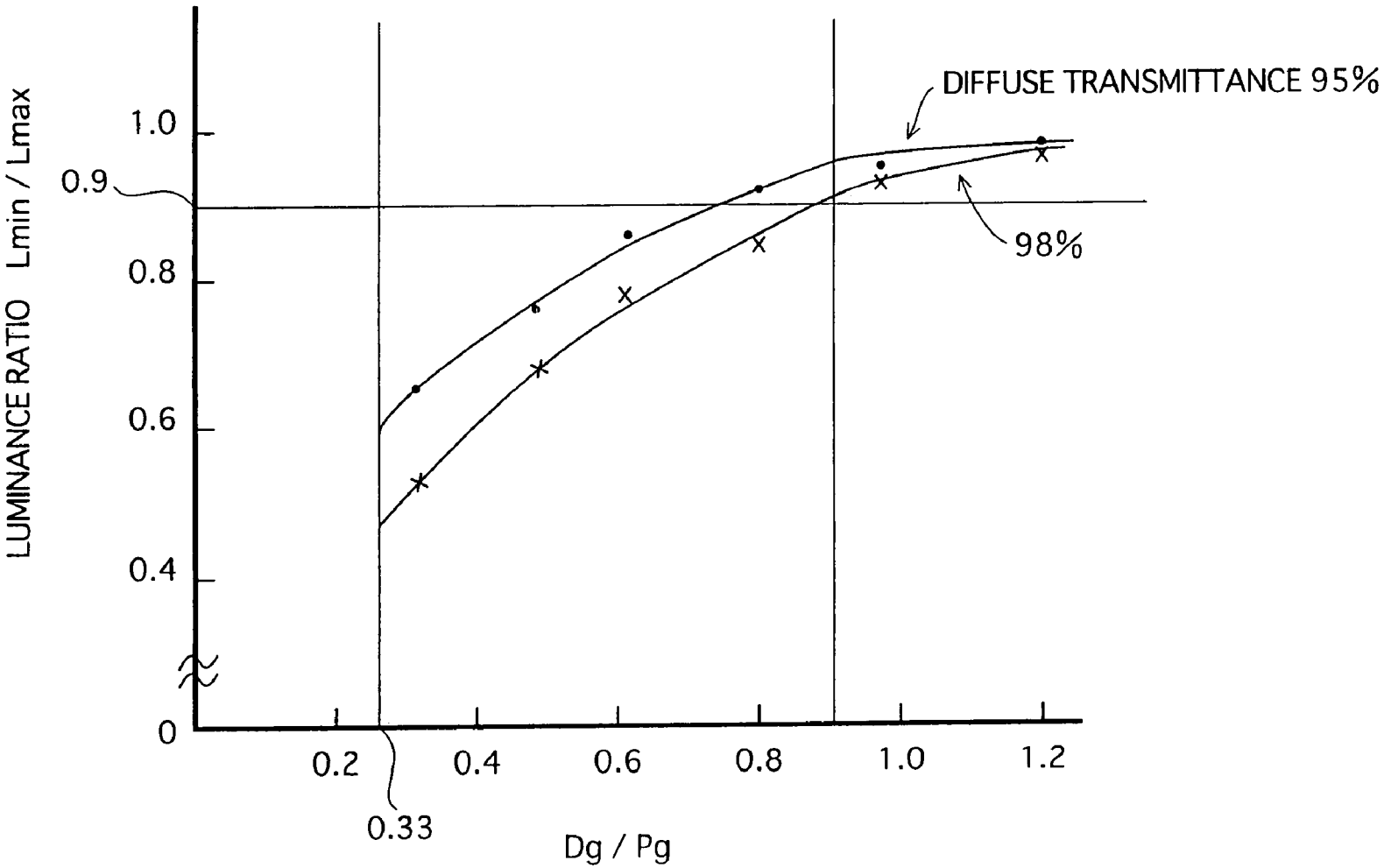
FIG. 5 is a graph showing a relation between a value of $D_g/P_g$ and a luminance ratio $L_{min}/L_{max}$ when a diffuse transmittance of a globe τ is 95% or 98%.

FIG. 5 is a graph illustrating the relation between the value of $D_g/P_g$ and the luminance ratio $L_{min}/L_{max}$, based on the result of the above experiment, when the diffuse transmittance $\tau$ of the globe is 95% or 98%. According to visual observation, if the luminance ratio $L_{min}/L_{max}$ is no less than 0.9, unevenness of luminance is scarcely recognized, and excellent appearance can be achieved.

As shown in FIG. 5, whether the diffuse transmittance $\tau$ the globe is 95% or 98%, as the value of $D_g/P_g$ becomes larger, the luminance ratio $L_{min}/L_{max}$ becomes larger.

The luminance ratio $L_{min}/L_{max}$ increment becomes smaller, as the value of $D_g/P_g$ becomes larger. The luminance ratio $L_{min}/L_{max}$ ultimately reaches the vicinity of 1.0 which means no unevenness of luminance.

As shown in FIG. 5, when the diffuse transmittance $\tau$ of the globe is 95%, if the value of $D_g/P_g$ is greater than 0.8, the luminance ratio $L_{min}/L_{max}$ is more than 0.9, and therefore excellent appearance can be achieved as proved by visual observation.

Here, when the value of $D_g/P_g$ is greater than 0.8, the luminaire efficiency is around 72.3 1m/W, which is equal to the luminaire efficiency of a conventional compact self-ballasted fluorescent lamp whose globe has the diffuse transmittance τ of 95%.

Note that the value of $D_g/P_g$ is 0.33 for such a conventional compact self-ballasted fluorescent lamp. It can be seen from FIG. 5 that such a conventional compact self-ballasted fluorescent lamp can not achieve a sufficiently high luminance.

FIG. 5 shows that, when the diffuse transmittance τ of a globe is 98%, if the value of $D_g/P_g$ is greater than 0.9, the luminance ratio $L_{min}/L_{max}$ is more than 0.9. In this case, luminaire efficiency is, by around 3%, higher than that of the above-mentioned conventional compact self-ballasted fluorescent lamp whose glove has the diffuse transmittance τ of 95%.

In conclusion, when the diffuse transmittance τ of a globe is 98%, the value of $D_g/P_g$ is preferably 0.9 or more, and when the diffuse transmittance τ of a globe is 95%, the value of $D_g/P_g$ is preferably 0.8 or more.

[3] Points to Remember When Manufacturing the Glass Tube 204

As described above, the compact self-ballasted fluorescent lamp according to the present invention has a feature that the value of $D_g/P_g$ is no less than a predetermined value. To realize this feature with maintaining the same globe size as that of an ordinary electric lamp, the maximum gap $D_g$ needs to be increased. This means that the helix diameter of the glass tube 204 Φt needs to be decreased.

However, reducing the helix diameter of the glass tube 204 Φt has the following problem.

FIG. 6 illustrates a step-by-step process of manufacturing a helical shaped glass tube. Firstly, a linear glass tube 301 is heated using a glass furnace 302 until the glass tube 301 reaches slightly under 700□C to be softened (FIG. 6(*i*)).

The glass furnace 302 may be an electric furnace or an gas furnace.

After this, the softened glass tube 301 is placed on a forming jig 305 in such a manner that the middle portion of the glass tube 301 corresponds to the top end of the forming jig 305. The forming jig 305 has a double helical slope. Then, the forming jig 305 is rotated, so that the softened glass tube 301 is wound around the forming jig 305.

After this, the glass tube 301 in a state of being wound around the forming jig 305 is left at room temperature, to be cooled down and resolidified. Then, the forming jig 305 is rotated in a direction reverse to the previous rotation, so that the glass tube 301 that has been processed to form a helical configuration can be taken off the forming jig 305 (FIG. 6(*iii*)).

Since the forming jig 305 is made of high carbon steel, it hardly expands or contracts when the glass tube 301 at high temperature is wound around it or when it is cooled down to room temperature.

FIG. 6(*ii*) shows the glass tube 301 in a state of being wound around the forming jig 305 when seen from the direction of the rotation axis of the forming jig 305.

Here, if the above-described manufacturing process is employed to manufacture a helical shaped glass tube with a small helix diameter Φt, the diameter of the forming jig 305 needs to be small.

However, if the diameter of the forming jig 305 is small, the side of the glass tube 301 that corresponds to the helix circumference extends excessively when the glass tube 301 is wound around the forming jig 305.

This poses a problem that the glass tube 301 being wound around the forming jig 305 is easy to come off. Here, if the glass tube 301 is wound around the forming jig 305 with force so as not to come off, the glass tube 301 may stretch lengthwise depending on the amount of the force.

In addition, even if the force is reduced so as not to cause the glass tube 301 to stretch lengthwise, the configuration of the glass tube 301 after cooling may be distorted. An example of the glass tube 301 having such a distorted configuration is shown in FIG. 7.

Figure 7:
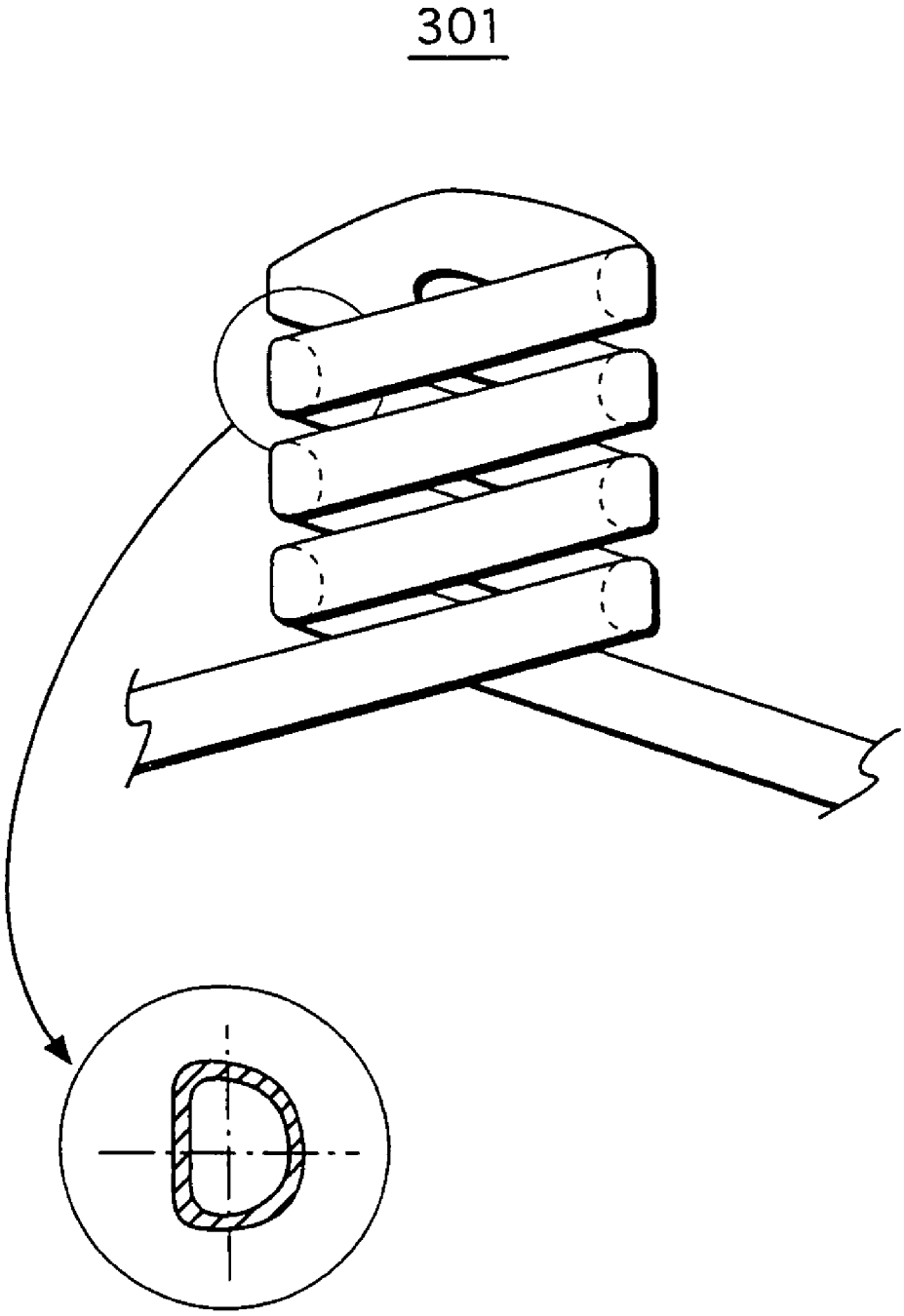
FIG. 7 shows an external view and a cross section of a glass tube that has been processed at an inappropriate forming temperature and therefore become distorted.

FIG. 7 illustrates the cross section of the glass tube 301 having a distorted configuration. The inner half of the circumference of the glass tube 301 correctly draws an arc because of the forming jig 305. On the other hand, though the outer half of the circumference is expected to swollen like an arc, it is flat as if it were squashed.

Here, whether finished dimensions of the glass tube 301 are equivalent to designed dimensions, that is to say, finished dimension accuracy was examined. In this examination, the tube inside diameter of the glass tube 301 ϕi was varied within a range of 5.0 mm to 9.0 mm, the tube outside diameter of the glass tube 301 ϕo within a range of 6.2 mm to 10.8 mm so as to correspond to the variation range of the inside diameter ϕi, and the wall thickness of the glass tube 301 within a range of 0.8 mm to 0.9 mm. Here, the value of $D_g/P_g$ was adjusted so as to be 0.8 or greater.

According to this examination, the finished dimension accuracy of the glass tube 301 is subject to three parameters of the tube outside diameter ϕo, the helix diameter Φt and the helical pitch $P_g$. More specifically, a larger tube outside diameter ϕo, a smaller helix diameter Φt and a smaller helical pitch $P_g$ tend to lower the finished dimension accuracy.

Which is to say, the finished dimension accuracy of the glass tube 301 is low if the side of the glass tube 301 that corresponds to the helix circumference substantially extends when the glass tube 301 is wound around the forming jig.

This examination has revealed the following. When the helical pitch $P_g$ of the glass tube 301 is no more than 12 mm and the ratio of the tube outside diameter ϕo to the helix diameter Φt (Φt/ϕo) is within a range of 3.5 to 4.5, excellent finished dimension accuracy is achieved if the temperature of the glass tube 301 when it is taken out of the glass furnace 302 (hereinafter referred to as forming temperature) is set, by from 50° C. to 150° C., higher than the softening point of the glass material of the glass tube 301.

For example, if lead glass is used for the glass tube 301 (model number L-29F of Nippon Electric Glass Co., Ltd.), excellent finished dimension accuracy can be achieved when the forming temperature is set within a range of 665° C. to 765° C. since the softening point of the glass material is 615° C.

Instead, if leadless glass may be used for the glass tube 301 (model number PS-94 of Nippon Electric Glass Co., Ltd.), the forming temperature is set within a range of 732° C. to 832° C., since the softening point of the glass material is 682° C.

Moreover, if the glass material of the model number P360 of Royal Philips Electronics of the Netherlands is used for the glass tube 301, excellent finished dimension accuracy can be achieved when the forming temperature is set within a range of 725° C. to 825° C., since the softening point of the glass material is 675° C.

The glass tube 204 used in the embodiment is made of barium strontium silicate glass as mentioned above, but can be made of soft glass such as soda lime glass and barium silicate glass.

When using such a soft glass material for the glass tube 301, excellent finished dimensions accuracy can be also achieved if the forming temperature is set, by from 50° C. to 150° C., higher than the softening point of the soft glass material.

Note that, if the forming temperature for the glass tube 301 is set, by 150° C. or more, higher than the softening point of the glass material for the glass tube 301, the glass tube 301 is too softened to be processed.

In conclusion, when the designed dimensions of a helical shaped glass tube include a helical pitch $P_g$ of no more than 12 mm, and the ratio $\Phi t/\phi o$ of from 3.5 to 4.5, the helical shaped glass tube is completed with high finished dimension accuracy if the forming temperature is set, by from 50° C. to 150° C., higher than the softening point of the glass material for the glass tube 301.

The present invention is described based on the embodiment in the above part. However, the present invention is not limited to the above embodiment. A modification example is explained in the following part.

[4] Modification Example (1) The compact self-ballasted fluorescent lamp having the following configuration also produces the effects of the present invention, in addition to the compact self-ballasted fluorescent lamp relating to the above embodiment. The specifications of a compact self-ballasted fluorescent lamp relating to a modification example of the above-mentioned embodiment are shown in FIG. 8.

The compact self-ballasted fluorescent lamp relating to the modification example includes a glass tube made of barium strontium silicate glass. Accordingly, if the glass tube is processed under the conditions described in the embodiment, a satisfactory finished dimensions accuracy is achieved.

The luminance ratio $L_{min}/L_{max}$ for the compact self-ballasted fluorescent lamp relating to the modification example is 0.93, which means that unevenness of luminance is reduced so as to be invisible for human eyes.

The luminaire efficiency is 75.2 lm/W, which is approximately 4% higher than that of a conventional compact self-ballasted fluorescent lamp. In addition, it has been proved that the compact self-ballasted fluorescent lamp relating to the modification example assures a rated lifetime of longer than 6,000 hours.

Since the tube inside diameter of the glass tube $\phi i$ is within a range of 5.0 mm to 9.0 mm, the luminous flux rising characteristic can be equal to that of an ordinary fluorescent lamp, if a heat-conductive medium is used as in the above-described embodiment.

In other words, the luminous flux immediately after illumination at room temperature is 70% or greater of the luminous flux under steady illumination. The dimensions of the outer peripheral case are made smaller than those of an ordinary electric lamp. Therefore, the compatibility of the compact self-ballasted fluorescent lamp relating to the modification example with a lamp holder for ordinary electric lamps is as high as 80% or more.

(2) The above-mentioned embodiment solely explains an 11-watt compact self-ballasted fluorescent lamp which is to be used as an alternative to an ordinary 60-watt electric lamp. However, the effects of the present invention are also obtained when the present invention is applied to a compact self-ballasted fluorescent lamp of a different wattage which is designed as an alternative to an ordinary 40-watt or 100-watt electric lamp.

(3) The above embodiment exclusively describes a case in which a diffuser is formed on the inner surface of a globe to diffuse emitted light. However, the present invention is not limited to such.

As an alternative, the diffuser may be formed on the outer surface of the globe. In addition, a frosted globe or a globe made of a translucent resin material may be used. In this way, the effects of the present invention can be also obtained.

(4) In the above embodiment, the present invention is solely applied to a compact self-ballasted fluorescent lamp, but may be applied to a fluorescent lamp with a globe.

Here, a fluorescent lamp with a globe indicates a lamp principally constituted by an arc tube (fluorescent tube), a base, and a power supplying terminal, and the globe mantles the arc tube as in the embodiment.

The power supplying terminal of the fluorescent lamp may be stick- or cap-shaped. Actually, the power supplying terminal can have any shape as long as it is able to receive power supply from outside.

Figure 9:
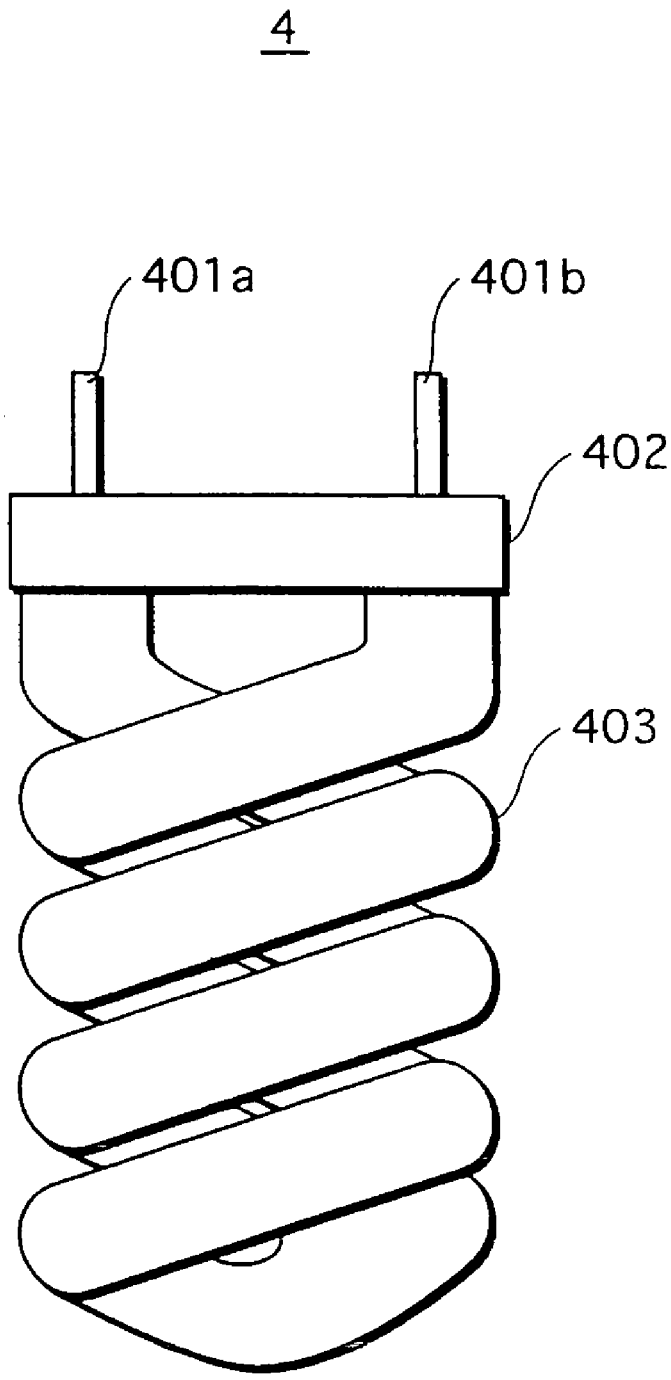
FIG.9 PRIOR ART
FIG. 9 is an external view showing a construction of a typical florescent lamp.

FIG. 9 is an external view showing a configuration of a typical fluorescent lamp 4 that includes power supplying terminals 401*a*, 401*b*, a base 402, a glass tube that has been processed to have a helical configuration 403. The power supplying terminals 401*a* and 401*b* shown in FIG. 9 are stick-shaped. A globe is fixed to and supported by the base 402.

Here, it is assumed that a typical fluorescent lamp does not include an electronic circuit such as an electronic ballast and a electronic starter. Such an electronic circuit is relatively expensive and has a longer lifetime, compared with other constituents of a lighting equipment. Accordingly, there is a market demand for the following luminaire. An electronic circuit is included in a lamp holder, so that the exchangeable part of the luminaire is only a fluorescent lamp, which has relatively short lifetime.

If the present invention is applied to a fluorescent lamp with a globe has a configuration of this type of luminaire, the market demand is satisfied and the same effects as the above embodiment can be produced.

[5] Effects of the Present Invention

According to the compact self-ballasted florescent lamp of the present invention, the value of $D_g/P_g$ is no less than a predetermined value as described above, so as that unevenness of luminance is suppressed and excellent appearance is achieved.

In addition, when manufacturing a glass tube included in the compact self-ballasted florescent lamp according to the present invention, the forming temperature is set, by from 50° C. to 150° C., higher than the softening point of the glass material for the glass tube. Thus, a compact self-ballasted fluorescent lamp with excellent finished dimensions accuracy can be realized.

INDUSTRIAL APPLICABILITY

The present invention relates to a compact self-ballasted florescent lamp, a florescent lamp, and a manufacturing method of a helical glass tube, particularly to improvement of unevenness in luminance of the compact self-ballasted florescent lamp.

The invention claimed is:

1. A compact self-ballasted fluorescent lamp in which a globe mantles an arc tube having a helical configuration, characterized in that when $P_g$ is a helical pitch of the arc tube and $D_g$ is a half of a difference between a maximum outside diameter of the globe and a helix diameter of the arc tube, a ratio of $D_g/P_g$ is 0.8 or more.

2. The compact self-ballasted fluorescent lamp of claim 1, wherein the globe is light diffusive.

3. The compact self-ballasted fluorescent lamp of claim 2, wherein a diffuse transmittance of the globe is 95% or higher.

4. The compact self-ballasted fluorescent lamp of claim 2, wherein the ratio of $D_g/P_g$ is 0.9 or more, and a diffuse transmittance of the globe is 98% or higher.

5. The compact self-ballasted fluorescent lamp of claim 1, wherein elemental mercury is enclosed into the arc tube, a tube inside diameter of the arc tube is within a range of 5.0 mm to 9.0 mm, and a part of the arc tube is thermally connected to the globe by means of a heat-conductive medium.

6. The compact self-ballasted fluorescent lamp of claim 5, wherein the part of the arc tube includes a coldest point in the arc tube.

7. The compact self-ballasted fluorescent lamp of claim 5, wherein the heat-conductive medium is made of silicone.

8. The compact self-ballasted fluorescent lamp of claim 1, wherein the maximum outside diameter of the globe is approximately 60 mm or less.

9. A fluorescent lamp in which a globe mantles an arc tube having a helical configuration, characterized in that when $P_g$ is a helical pitch of the arc tube and $D_g$ is a half of a difference between a maximum outside diameter of the globe and a helix diameter of the arc tube, a ratio of $D_g/P_g$ is 0.8 or more.

10. The fluorescent lamp of claim 9, wherein the globe is light diffusive.

11. The fluorescent lamp of claim 10, wherein a diffuse transmittance of the globe is 95% or higher.

12. The fluorescent lamp of claim 10, wherein the ratio of $D_g/P_g$ is 0.9 or more, and a diffuse transmittance of the globe is 98% or higher.

13. The fluorescent lamp of claim 12, wherein elemental mercury is enclosed into the arc tube, a tube inside diameter of the arc tube is within a range of 5.0 mm to 9.0 mm, and a part of the arc tube is thermally connected to the globe by means of a heat-conductive medium.

14. The fluorescent lamp of claim 13, wherein the part of the arc tube includes a coldest point in the arc tube.

15. The fluorescent lamp of claim 13, wherein the heat-conductive medium is made of silicone.

16. The fluorescent lamp of claim 12, wherein the maximum outside diameter of the globe is approximately 60 mm or less.

17. A manufacturing method of a helical glass tube that is formed by a glass tube made of a soft glass material, the helical glass tube having a helical pitch of no more than 12 mm and a $\Phi t/\phi o$ ratio of within a range of 3.5 to 4.5, where $\Phi t$ is a helix diameter of the helical glass tube and $\phi o$ is a tube outside diameter of the helical glass tube, the manufacturing method comprising:

a heating step of heating the glass tube to be softened; and a forming step of, around a forming jig having a helical configuration, winding the glass tube that has been softened in the heating step at a forming temperature which is, by from 50° C. to 150° C., higher than a softening point of the soft glass material to form the helical glass tube.

18. A compact self-ballasted fluorescent lamp in which a globe mantles an arc tube having a helical configuration, characterized in that when $P_g$ is a helical pitch of the arc tube and $D_g$ is a half of a difference between a maximum outside diameter of the globe and a helix diameter of the arc tube, a ratio of $D_g/P_g$ is 0.8 or more and the arc tube is formed by a helical glass tube that is manufactured by the method of claim 17.

19. A fluorescent lamp in which a globe mantles an arc tube having a helical configuration, characterized in that when $P_g$ is a helical pitch of the arc tube and $D_g$ is a half of a difference between a maximum outside diameter of the globe and a helix diameter of the arc tube, a ratio of $D_g/P_g$ is 0.8 or more and the arc tube is formed by a helical glass tube that is manufactured by the method of claim 17.

20. A manufacturing method of a helical glass tube that is formed by a glass tube made of a soft glass material, the helical glass tube having a helical pitch of no more than 12 mm and a $\Phi t/\phi o$ ratio of within a range of 3.5 to 4.5, where $\Phi t$ is a helix diameter of the helical glass tube and $\phi o$ is a tube outside diameter of the helical glass tube, the manufacturing method comprising:

a heating step of heating the glass tube to be softened; and a forming step of, around a forming jig having a helical configuration, winding the glass tube that has been softened in the heating step at a forming temperature of within a range between 725° C. and 825° C. to form the helical glass tube.

21. A compact self-ballasted fluorescent lamp in which a globe mantles an arc tube having a helical configuration, characterized in that when $P_g$ is a helical pitch of the arc tube and $D_g$ is a half of a difference between a maximum outside diameter of the globe and a helix diameter of the arc tube, a ratio of $D_g/P_g$ is 0.8 or more and the arc tube is formed by a helical glass tube that is manufactured by the method of claim 20.

22. A fluorescent lamp in which a globe mantles an arc tube having a helical configuration, characterized in that when $P_g$ is a helical pitch of the arc tube and $D_g$ is a half of a difference between a maximum outside diameter of the globe and a helix diameter of the arc tube, a ratio of $D_g/P_g$ is 0.8 or more and the arc tube is formed by a helical glass tube that is manufactured by the method of claim 20.

* * * * *